US009583093B2

(12) United States Patent
Coates

(10) Patent No.: US 9,583,093 B2
(45) Date of Patent: Feb. 28, 2017

(54) SOUND DEFLECTING APPARATUS

(71) Applicant: Stanley G. Coates, Proctorville, OH (US)

(72) Inventor: Stanley G. Coates, Proctorville, OH (US)

( * ) Notice: Subject to any disclaimer, the term of this patent is extended or adjusted under 35 U.S.C. 154(b) by 0 days.

(21) Appl. No.: 14/839,827

(22) Filed: Aug. 28, 2015

(65) Prior Publication Data

US 2015/0371625 A1 Dec. 24, 2015

Related U.S. Application Data

(63) Continuation-in-part of application No. 13/846,313, filed on Jul. 10, 2013, now abandoned.

(51) Int. Cl.
*H04R 7/00* (2006.01)
*G10K 11/28* (2006.01)

(52) U.S. Cl.
CPC ..... *G10K 11/28* (2013.01)

(58) Field of Classification Search
CPC ..... H04R 1/345
USPC ..... 181/191
See application file for complete search history.

(56) References Cited

U.S. PATENT DOCUMENTS 1,786,279 A * 12/1930 Wolff ..... H04R 1/345 181/155
4,134,324 A * 1/1979 LeMert ..... G10D 13/021 181/191
5,220,608 A * 6/1993 Pfister ..... H04R 1/345 181/155
7,596,236 B2 * 9/2009 Vincenot ..... H04R 1/345 181/191
8,036,403 B2 * 10/2011 Xi ..... H04R 1/345 181/187
D728,535 S 5/2015 Degenkolb
2012/0241247 A1 * 9/2012 Choe ..... H04R 1/345 181/191

* cited by examiner

*Primary Examiner* — Forrest M Phillips
(74) *Attorney, Agent, or Firm* — York Law LLC; Olen York

(57) ABSTRACT

A sound deflector apparatus having mutually coextensive tab and wall portions, the tab portion mounted to an area of an electronic device adjacent the speaker outlet(s), and the wall portion having a curvilinear segment or bend directing sound waves toward the listener(s) viewing programming on a flat-screen television, monitor, smart device, and/or similar electronic devices with such speaker outlet configurations.

20 Claims, 2 Drawing Sheets

SOUND DEFLECTING APPARATUS

PRIOR APPLICATION

This application is a continuation-in-part of U.S. patent application Ser. No. 13/846,313, filed on Jul. 10, 2013.

FIELD OF THE INVENTION

The present application discloses and describes a sound deflecting apparatus.

BACKGROUND OF THE INVENTION

For several years, flat screen televisions and other electronic devices with audio playback and sound systems have been known to provide inadequate sound volume and quality to the listening audience. Manufacturers of flat screen monitors, televisions, laptop and PC computers, hand held smart devices (including tablets and phones), and the like have chosen to sacrifice sound quality in favor of a clear television surface. This in turn distorts the sound quality, especially to those having minor hearing deficiencies.

Poor sound quality has been document in many reviews of such devices, and especially for flat screen televisions and monitors used in home entertainment settings. At the present time, the only way to correct this problem is to separately purchase a stand-alone single component or multi-component sound or amplification system to boost the sound and quality levels and to specifically direct the amplified sound at the listener. However, such sound systems are usually quite expensive, and often cost prohibitive, especially when the listener can often raise the sound level through the remote or television controller. Yet, raising the sound level of the television or monitor through the remote or television controller causes several additional problems, including sound quality distortion, speaker and sound reverberation, distracting echo and/or feedback, as well as causing annoyance to other inhabitants of the dwelling because of the boosted sound signal, reverberation, and/or echo.

This problem is particular acute with senior citizens, who often have minor to significant hearing problems associated with aging and/or earlier damage or injury from work-related exposure(s). However, many of the hearing problems associated with aging and/or injury/damage have been typically addressed through expensive surgical and/or medical appliance installations, the purchase of expensive assisted listening devices or systems, or combinations thereof.

Yet, the problem of sound signal and quality is not only a problem for senior citizens, this has been a problem for anyone that uses electronic devices with built-in speaker systems that are designed to consume as little space as possible. Flat-screen televisions, monitors, and hand-held devices are progressively designed to be thinner and lighter, thereby limiting the placement or location of speakers outlets and the necessary components to provide acceptable sound level and quality controls. For example, many flat screen television and monitor speakers are located along the lateral edges of such devices, with a small, defined width to accommodate the speaker outlet and components, which provides an particular or specific aesthetic appearance to the visible surface of the device, but fails to optimize sound level and quality. Moreover, hand-held devices (such as smart phones and tablets) are dimensionally designed so that speaker outlet placement often is facing downwardly or away from the user, such as along the backside of the device.

Accordingly, there is a need for a device or apparatus that improves the sound level, intensity, and/or quality.

SUMMARY OF THE INVENTION

Example embodiments provide a sound deflecting apparatus having general application as an apparatus for installation on an electronic device, such as a television, monitor, or hand-held computing device adjacent at least one speaker outlet for amplifying, intensifying, and/or re-directing audio playback toward the listener(s).

In one embodiment, a sound deflecting apparatus comprises a tab and a wall, the tab and wall mutually coextensive, the wall comprising a curvilinear segment, and installation means coupling the tab to an area adjacent at least one audio speaker outlet.

In another embodiment, a sound deflecting apparatus comprises a tab and a wall, the tab and wall mutually coextensive, the wall comprising a curvilinear segment, and installation means comprising two-sided adhesive coupling the tab to an area adjacent at least one audio speaker outlet.

In another embodiment, a sound deflecting apparatus comprises a tab and a wall, the tab and wall mutually coextensive, the tab comprises an obverse face and a reverse face, the tab bound along its perimeter by an upper tab margin and mutually opposing lateral tab margins, the tab having a lateral width comprising less than the width of the wall, and the tab having a lateral height comprising less than the height of the wall, the wall comprising an obverse face and reverse face, the wall bound along the perimeter by upper wall margin and lower wall margin and lateral wall margins, the upper wall margin and lower wall margin mutually opposed, and the lateral wall margins mutually opposed, the wall comprising a curvilinear segment intermediately disposed between upper wall margin and lower wall margin, and installation means comprising two-sided adhesive coupling the tab to an area adjacent at least one audio speaker outlet.

It is envisioned that each embodiment may include a tab having a length that is variable in manufacture or assembly to a width slightly less than to a width significantly less than the width of the wall, along either or both of the obverse and/or reverse face(s). It is also envisioned that each embodiment may include a tab having a height that is variable in manufacture and assembly to a height slightly less than to a height significantly less than the height of the wall.

It is envisioned that each embodiment may include a curvilinear wall having a curvilinear segment or bend disposed between the upper wall margin and lower wall margin, the curvilinear segment or bend variable in intermediate placement therebetween.

It is envisioned that each embodiment may include installation means comprising mechanical interlocking, interference, and/or fasteners, and/or combinations and sub-combinations thereof.

It is envisioned that another embodiment comprises a method of installation, a method of using, and alternative arrangements and configurations of the apparatus embodiments disclosed herein.

DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
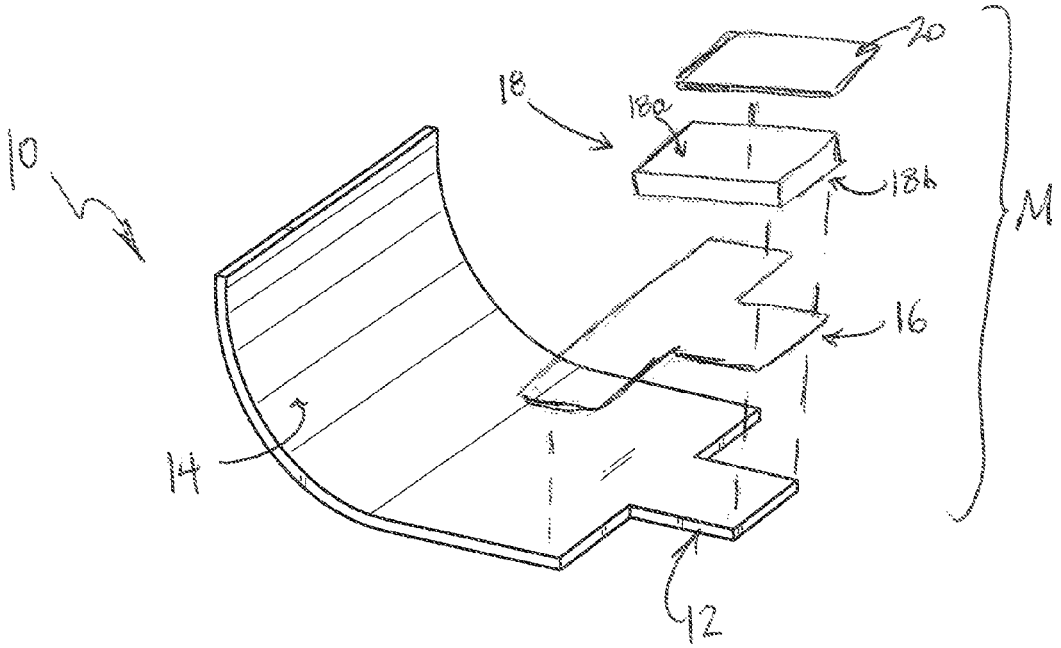
FIG. 1 is an exploded view of a sound deflector.
Figure 2:
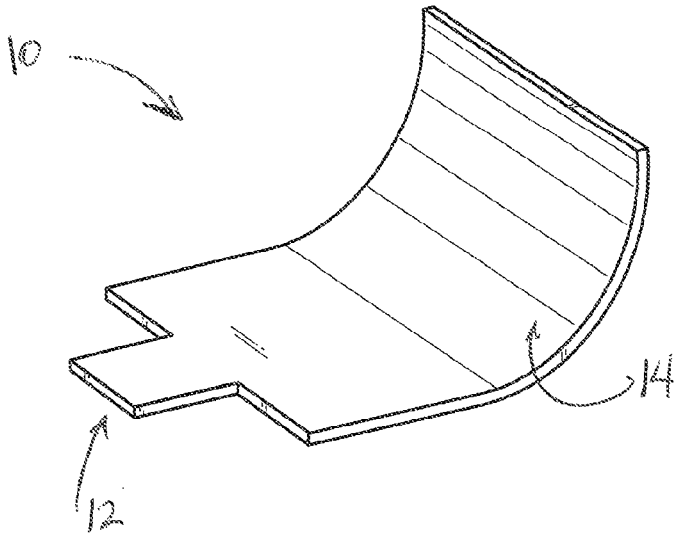
FIG. 2 is a perspective view of the sound deflector depicted in FIG. 1.
Figure 3:
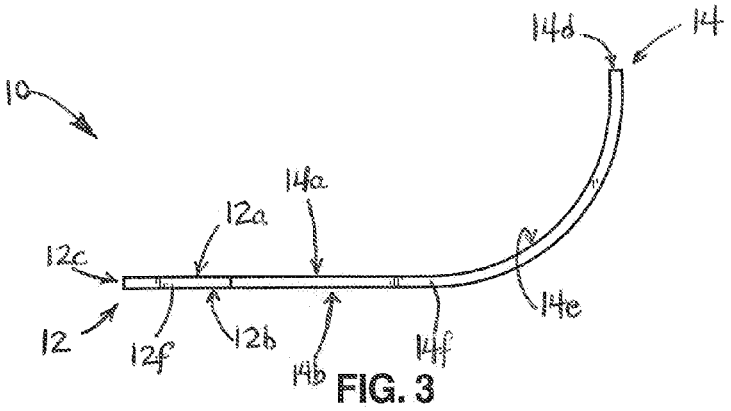
FIG. 3 and FIG. 4 are side views of the sound deflector depicted in FIGS. 1 and 2.
Figure 4:
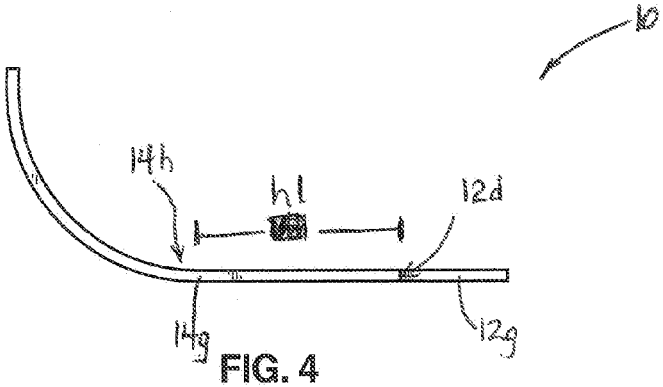
Figure 5:
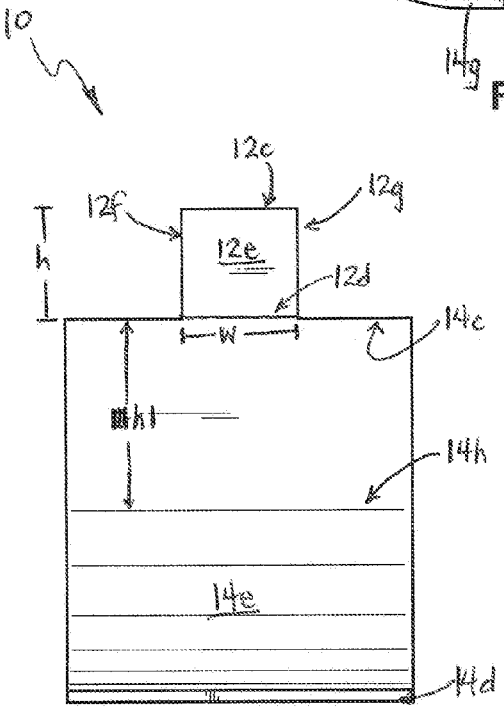
FIG. 5 is a front view of the sound deflector depicted in FIGS. 1 through 4.
Figure 6:
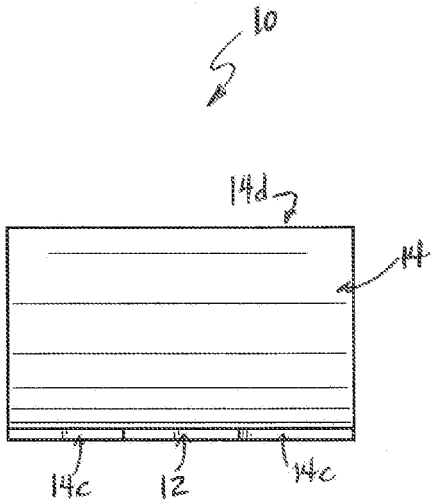
FIG. 6 is a top view of the sound deflector depicted in FIGS. 1 through 5.

In accordance with the drawings illustrating at least one embodiment of a sound deflector, as generally depicted in FIG. 1 through FIG. 6, a sound deflector 10 comprises a mounting tab 12 and a curvilinear wall 14, the tab 12 and wall 14 mutually coextensive to provide an integral or assembled adjacent relationship. It is envisioned that tab 12 and wall 14 may be manufactured as an integral unit from the same material blank and cut to appropriate dimensions. Likewise, it is further envisioned that tab 12 and wall 14 may be manufactured as separate elements (either from the same, similar, and/or different materials), and then assembled through mating or coupling, utilizing one of multiple means or methods for such mating or coupling, such as mechanical weld(s), mechanical fastener(s), mechanical interlock and/or interference impingement, chemical application(s), adhesive(s), and combinations or sub-combinations thereof.

The tab 12 may comprise obverse 12*a* and reverse 12*b* sides, faces, or surfaces. The tab 12 may be bound along its perimeter by upper margin 12C, and lateral margins 12*f* and 12*g*. In one embodiment, the tab 12 may be separately constructed from the wall 14, therefore, a lower margin 12*d* of tab 12 may be provided, the lower margin 12*d* forming the physical location of any mating, coupling, joining, or assembly with the wall 14 in forming the device or apparatus 10. In another embodiment, area between margins 12C and 12*d* and 12*f* and 12*g* may be denoted by 12*e* and defined as a substantially planar element tab body (12*e*). In another embodiment, the tab body 12*e* may comprise a flexible material for accommodating minor positional manipulation for installation of the device/apparatus 10 on an electronic device. In another embodiment, the tab body 12*e* may comprise a flexible corrugation, accordion, bellows, and/or pleated portion for accommodating minor positional manipulation for installation of device/apparatus 10, whereby the respective flexible corrugated or accordion/bellows/pleated portion is compressible and de-compressible to accommodate such installation manipulation.

The wall 14 may comprise obverse 14*a* and reverse 14*b* sides, faces, or surfaces. The wall 14 may be bound along its perimeter by upper margin 14*c*, lower margin 14*d* (in non-planar opposition to upper margin 14*c*), and lateral margins 14*f* and 14*g*. A curvilinear segment or bend 14*e* is intermediately disposed between upper and lower margins 14*c* and 14*d*, causing the non-planar opposition positional/spatial relationships of margins 14*c* and 14*d*.

The tab 12 may comprise a lateral width or length ("w") and may be generally denoted as less than the width or length of the lateral margins (14*f* to 14*g*) of the wall 14. It is envisioned that the lateral width or length ("w") of tab 12 may be set at any width or length that is less than the width or length of the lateral margins (14*f* to 14*g*) of wall 14, including a lateral width or length ("w") slight less than the width/length between margins 14*f*/14*g* to a smaller width/length ("w") that is significantly lesser than the width/length between margins 14*f*/14*g*. It is envisioned that one embodiment may include a lateral width/length ("w") within the range of 5% to 99% of the width/length 14*f* to 14*g* of wall 14. It is also envisioned that another embodiment may include a lateral width/length ("w") at least 10% of the width/length 14*f* to 14*g* of wall 14. It is also envisioned that another embodiment may include a lateral width/length ("w") at least 20% of the width/length 14*f* to 14*g* of wall 14. It is also envisioned that another embodiment may include a lateral width/length ("w") at least 25% of the width/length 14*f* to 14*g* of wall 14. It is also envisioned that another embodiment may include a lateral width/length ("w") at least 30% of the width/length 14*f* to 14*g* of wall 14. It is also envisioned that another embodiment may include a lateral width/length ("w") at least 33% of the width/length 14*f* to 14*g* of wall 14. It is also envisioned that another embodiment may include a lateral width/length ("w") at least 50% of the width/length 14*f* to 14*g* of wall 14. It is also envisioned that another embodiment may include a lateral width/length ("w") at least 90% of the width/length 14*f* to 14*g* of wall 14. It is also envisioned that another embodiment may include a lateral width/length ("w") at least 95% of the width/length 14*f* to 14*g* of wall 14.

The tab 12 may have a lateral height or length ("h") and may be generally denoted as less than the height or length of the lateral margins (14*f* and 14*g*) of wall 14. It is envisioned that the lateral height/length ("h") may be less than the height/length of lateral margins (14*f* and 14*g*) as measured from the top margin (14*c*) of wall 14 to the start or beginning of the curvilinear bend (14*h*) of wall 14 (and denoted as hi). It is envisioned that the lateral height/length ("h") may be a proportional percentage of the height/length of lateral margins (14*f* and 14*g*) as measured from the top margin (14*c*) of wall 14 to the start/beginning of the curvilinear bend (14*h*) of wall 14 (and denoted as hi). It is further envisioned that the curvilinear segment or bend (14*h*) may be variable in intermediate disposition or placement between the upper margin 14*c* and lower margin 14*d* of the wall 14. It if further envisioned that the curvilinear segment or bend (14*h*) may comprise a variety or range of dimensions and angular configuration and alignment while still providing the increased sound level, intensity, and directional projection desired.

The device/apparatus 10 may further include installation means 16 for temporarily, semi-permanently, and/or permanently installing the device/apparatus 10 to an electronic device. In one embodiment, installation means ("M") may comprise two-sided adhesive 16 applied to the tab 12 and/or wall 14, with a releasable film provided on the obverse-side of the adhesive used for application to an electronic device surface. In one embodiment, the two-sided adhesive 16 may be formed and provided as a unitary application generally shown as a T-shaped application, applied to the tab 12 and adjacent the upper margin 14*c* of wall 14. It is also envisioned that the two-sided adhesive 16 may comprise two separate units or elements, a first adhesive 16*a* and a second adhesive 16*b*. The first adhesive 16*a* may comprise a shape substantially compatible to the tab 12, although it may not necessarily cover the entirety of the body 12*e* as defined. The second adhesive 1613 may comprise a shape substantially compatible to the lateral width/length of the upper margin 14*c* of wall 14.

In another embodiment, installation means ("M") may comprise a spacer 18 having an obverse 18*a* side/face/surface and a reverse 18*b* side/face/surface, wherein each obverse 18*a* and reverse IA surface has adhesive mated or coupled thereto, including applied adhesive, two-sided adhesive tape or film, and the like. The spacer's reverse surface 18*b* may be applied to the tab 12, and the spacer's obverse surface 18*a* may be applied to the surface of the electronic device. Although it is envisioned that spacer 18 may substantially cover the body 12*e* when applied, as depicted, it is also envisioned that spacer 18 may have dimensions smaller than the tab 12.

In another embodiment, installation means ("M") may comprise the combination of two-sided adhesive tape or film 16*a* and spacer 18 (with adhesive on surfaces 18*a* and in). In another embodiment, installation means ("M") may comprise the combination of two-sided adhesive tape or film 16*a* and spacer 18 (with adhesive on surfaces 18*a* and in), wherein the adhesive applied to surface 18*b* further includes an additional application of two-sided adhesive tape or film 20.

It is envisioned that spacer 18 may be utilized to accommodate unique speaker outlet configurations provided on a variety of electronic devices and/or as supplied by the variety of manufacturers presently in the market. If required or desired, as mated or coupled with the device/apparatus 10 (at tab 12) and mated or coupled to the rear surface of the electronic device (in most instances), the spacer 18 provides sufficient offset for the wall 14 of device/apparatus 10 to optimize sound level, intensity, and quality improvement(s).

It is further envisioned that installation means ("M") may comprise mechanical means for attaching and/or joining tab 12 to electronic device, including mechanical fasteners (e.g., screws, rivets) that minimize rear-surface marring of the electronic device. It is further envisioned that installation means ("M") may comprise a bracket or other mechanical support that may be installed on the electronic device and configured to receive the tab 12 in a variety of mechanically fastened, impinged, and/or adhered relationships.

Once installed on an electronic device, and especially adjacent to at least one audio speaker outlet, the sound deflector apparatus 10 operates or functions to re-direct the sound waves transmitted through the speaker outlet from a downward and/or opposite direction and instead toward the listener(s) viewing the television, monitor, or screen. The curvilinear wall 14 of the apparatus 10 is formed, arranged, and provides a re-direction of the sound waves directly to any listener(s) seated generally to the front of the television, monitor, and/or screen, thereby increasing the power, level, intensity, quality, and improving the overall sound distribution and balance otherwise absent without the apparatus 10 or otherwise requiring electronic components purchased and electronically connected to boost sound strength and clarity.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. A sound deflecting apparatus comprising:

a tab and a wall, the tab and wall mutually coextensive, the wall comprising a curvilinear segment; and installation means coupling the tab to an area adjacent at least one audio speaker outlet.

2. The apparatus of claim 1, wherein the tab comprises an obverse face and a reverse face, the tab bound along its perimeter by an upper tab margin and mutually opposing lateral tab margins.

3. The apparatus of claim 2, wherein the tab further comprises a lower tab margin, the upper tab margin and the lower tab margin mutually opposed.

4. The apparatus of claim 2, wherein the tab further comprises a tab body defined by the upper tab margin and the lateral tab margins.

5. The apparatus of claim 4, wherein the tab body further comprises flexible material.

6. The apparatus of claim 2, wherein the tab comprises a lateral width less than the width of the wall.

7. The apparatus of claim 6, wherein the tab comprises a lateral width less than 50% of the width of the wall.

8. The apparatus of claim 6, wherein the tab comprises a lateral height less than the height of the wall.

9. The apparatus of claim 6, wherein the tab comprises a lateral height that is a proportional percentage of the height of the wall.

10. The apparatus of claim 1, wherein installation means comprises adhesive applied to the tab and to the area adjacent at least one audio speaker outlet.

11. A sound deflecting apparatus comprising:

a tab and a wall, the tab and wall mutually coextensive, the wall comprising a curvilinear segment; and installation means comprising two-sided adhesive coupling the tab to an area adjacent at least one audio speaker outlet.

12. The apparatus of claim 11, wherein the wall comprises an obverse face and reverse face.

13. The apparatus of claim 12, wherein the wall is bound along its perimeter by upper wall margin and lower wall margin and lateral wall margins, and the lateral wall margins mutually opposed.

14. The apparatus of claim 12, wherein the wall comprises a curvilinear segment intermediately disposed between upper wall margin and lower wall margin.

15. The apparatus of claim 12, wherein installation means further comprises two-side adhesive coupling the tab and the wall to an area adjacent at least one audio speaker outlet.

16. The apparatus of claim 15, wherein installation, means further comprises a spacer intermediately disposed between the tab and the area adjacent at least one audio speaker outlet.

17. The apparatus of claim 16, wherein installation means further comprises a two-sided adhesive layer intermediately disposed between the spacer and the area adjacent at least one audio speaker outlet.

18. A sound deflecting apparatus comprising:

a tab and a wall, the tab and wall mutually coextensive;

the tab comprises an obverse face and a reverse face, the tab bound along its perimeter by an upper tab margin and mutually opposing lateral tab margins, the tab having a lateral width comprising less than the width of the wall, and the tab having a lateral height comprising less than the height of the wall;

the wall comprising an obverse face and reverse face, the wall bound along the perimeter by upper wall margin and lower wall margin and lateral wall margins, and the lateral wall margins mutually opposed, the wall comprising a curvilinear segment intermediately disposed between upper wall margin and lower wall margin; and installation means comprising two-sided adhesive coupling the tab to an area adjacent at least one audio speaker outlet.

19. The apparatus of claim 18, wherein installation means further comprises a spacer intermediately disposed between the tab and the area adjacent at least one audio speaker outlet.

20. The apparatus of claim 19, wherein installation means further comprises a two-sided adhesive layer intermediately disposed between the spacer and the area adjacent at least one audio speaker outlet.

* * * * *